US009793613B2

(12) United States Patent
Wilson et al.

(10) Patent No.: US 9,793,613 B2
(45) Date of Patent: Oct. 17, 2017

(54) ADDITIVE MANUFACTURING FOR RADIO FREQUENCY HARDWARE

(71) Applicant: The Boeing Company, Chicago, IL (US)

(72) Inventors: Allen Wayne Wilson, Westchester, CA (US); Patrick Chalit Pattamanuch, Los Angeles, CA (US); Leonard Rosenheck, Manhattan Beach, CA (US)

(73) Assignee: THE BOEING COMPANY, Chicago, IL (US)

( * ) Notice: Subject to any disclaimer, the term of this patent is extended or adjusted under 35 U.S.C. 154(b) by 723 days.

(21) Appl. No.: 14/049,861

(22) Filed: Oct. 9, 2013

(65) Prior Publication Data

US 2015/0097746 A1 Apr. 9, 2015

(51) Int. Cl.

| | |
|---|---|
| ***B24B 31/116*** | (2006.01) |
| ***H01Q 13/00*** | (2006.01) |
| ***H01P 11/00*** | (2006.01) |

(52) U.S. Cl.

CPC ..... *H01Q 13/00* (2013.01); *B24B 31/116* (2013.01); *H01P 11/002* (2013.01)

(58) Field of Classification Search

CPC ..... B24B 1/00; B24B 31/116
USPC ..... 451/36, 37, 58, 1
See application file for complete search history.

(56) References Cited

U.S. PATENT DOCUMENTS

| | | | | |
|---|---|---|---|---|
| 3,634,973 | A * | 1/1972 | McCarty | B24B 31/116 451/36 |
| 3,823,514 | A * | 7/1974 | Tsuchiya | B24B 31/116 451/114 |
| 5,807,163 | A * | 9/1998 | Perry | B24B 31/116 451/36 |
| 6,905,395 | B2 * | 6/2005 | Walch | B24B 49/16 451/113 |
| 2004/0266320 | A1 | 12/2004 | Walch | |
| 2012/0084968 | A1 | 4/2012 | Nath et al. | |

FOREIGN PATENT DOCUMENTS

| | | | |
|---|---|---|---|
| EP | 0608730 | A1 | 8/1994 |
| JP | H03196954 | A | 8/1991 |
| WO | WO2012076994 | A1 | 6/2012 |

OTHER PUBLICATIONS

International Search Report and Written Opinion, dated Nov. 19, 2014, regarding Application No. PCT/US2014/0252452, 12 pages.

* cited by examiner

*Primary Examiner* — Robert Rose
(74) *Attorney, Agent, or Firm* — Yee & Associates, P.C.

(57) ABSTRACT

A method and apparatus is presented. A structure having an interior channel is formed using additive manufacturing equipment. A viscous media containing abrasive particles is sent through the interior channel using abrasive flow machining equipment to form a desired surface roughness for the interior channel.

13 Claims, 6 Drawing Sheets

700

702
SPECIFICATION AND DESIGN
704
MATERIAL PROCUREMENT
706
COMPONENT AND SUBASSEMBLY MANUFACTURING
708
SYSTEM INTEGRATION
710
CERTIFICATION AND DELIVERY
712
IN SERVICE
714
MAINTENANCE AND SERVICE

800

AIRCRAFT
802
AIRFRAME
INTERIOR
806
SYSTEMS
PROPULSION SYSTEM
ELECTRICAL SYSTEM
808
812
810
814
804
HYDRAULIC SYSTEM
ENVIRONMENTAL SYSTEM

ADDITIVE MANUFACTURING FOR RADIO FREQUENCY HARDWARE

BACKGROUND INFORMATION

1. Field

The present disclosure relates generally to manufacturing and, in particular, to manufacturing radio frequency hardware. Still more particularly, the present disclosure relates to methods and apparatuses for manufacturing radio frequency hardware using additive manufacturing.

2. Background

Passive radio frequency devices may be used to receive, direct, or process waves within the radio frequency spectrum. Passive radio frequency devices may be hardware manufactured in shapes to receive, direct, or process radio frequency waves. The shape and material of manufacture of the passive radio frequency devices may influence the functionality of the devices. Further, the quality of manufacture of the passive radio frequency devices may influence the functionality of the devices.

For example, the surface roughness of passive radio frequency devices may affect the functionality of the devices. Undesirable surface roughness may cause undesirable changes in functionality of the devices, such as scattering loss.

Therefore, it would be desirable to have a method and apparatus that take into account at least some of the issues discussed above, as well as other possible issues.

SUMMARY

An illustrative embodiment of the present disclosure provides a method. A structure having an interior channel is formed using additive manufacturing equipment. A viscous media containing abrasive particles is sent through the interior channel using abrasive flow machining equipment to form a desired surface roughness for the interior channel.

Another illustrative embodiment of the present disclosure provides a method. A waveguide having an interior channel is formed using additive manufacturing equipment. A viscous media containing abrasive particles is sent through the interior channel using abrasive flow machining equipment to form a desired surface roughness for the interior channel. An antenna is assembled using the waveguide.

Yet another illustrative embodiment of the present disclosure provides a passive radio frequency device. The passive radio frequency device comprises a plurality of layers assembled through an additive manufacturing process and an interior channel having a desired surface roughness.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

The different illustrative embodiments recognize and take into account a number of different considerations. For example, the different illustrative embodiments recognize and take into account that additive manufacturing equipment may form structures having undesirable surface roughness. Specifically, the different illustrative embodiments recognize and take into account that additive manufacturing equipment may form passive radio frequency devices having undesirable surface roughness. This undesirable surface roughness may undesirably affect the functionality of passive radio frequency devices.

The different illustrative embodiments recognize and take into account that sanding or grinding of a surface having undesirable surface roughness may not result in a desired surface roughness. The different illustrative embodiments recognize and take into account that sanding may result in parallel scratches or gouges in a surface. These parallel scratches or gouges may result due to the size of particulate in the sanding or grinding material. Accordingly, sanding or grinding of a surface may not provide a desired surface roughness due to scratches or gouges.

The different illustrative embodiments recognize and take into account that sanding or grinding may not be used in channels in structures having complexities such as bends or turns. The different illustrative embodiments recognize and take into account that sanding or grinding materials such as sandpaper, plates, or wheels may not physically access a surface as desired in channels in structures having complexities such as bends or turns.

The illustrative embodiments further recognize and take into account that abrasive flow machining may be used to remove material from interior channels of structures. Accordingly, the illustrative embodiments recognize and take into account that the combination of additive manufacturing and abrasive flow machining may result in structures having desirable surface roughness. Further, the illustrative embodiments recognize and take into account that the combination of additive manufacturing and abrasive flow machining may result in passive radio frequency devices having desirable surface roughness.

Figure 1:
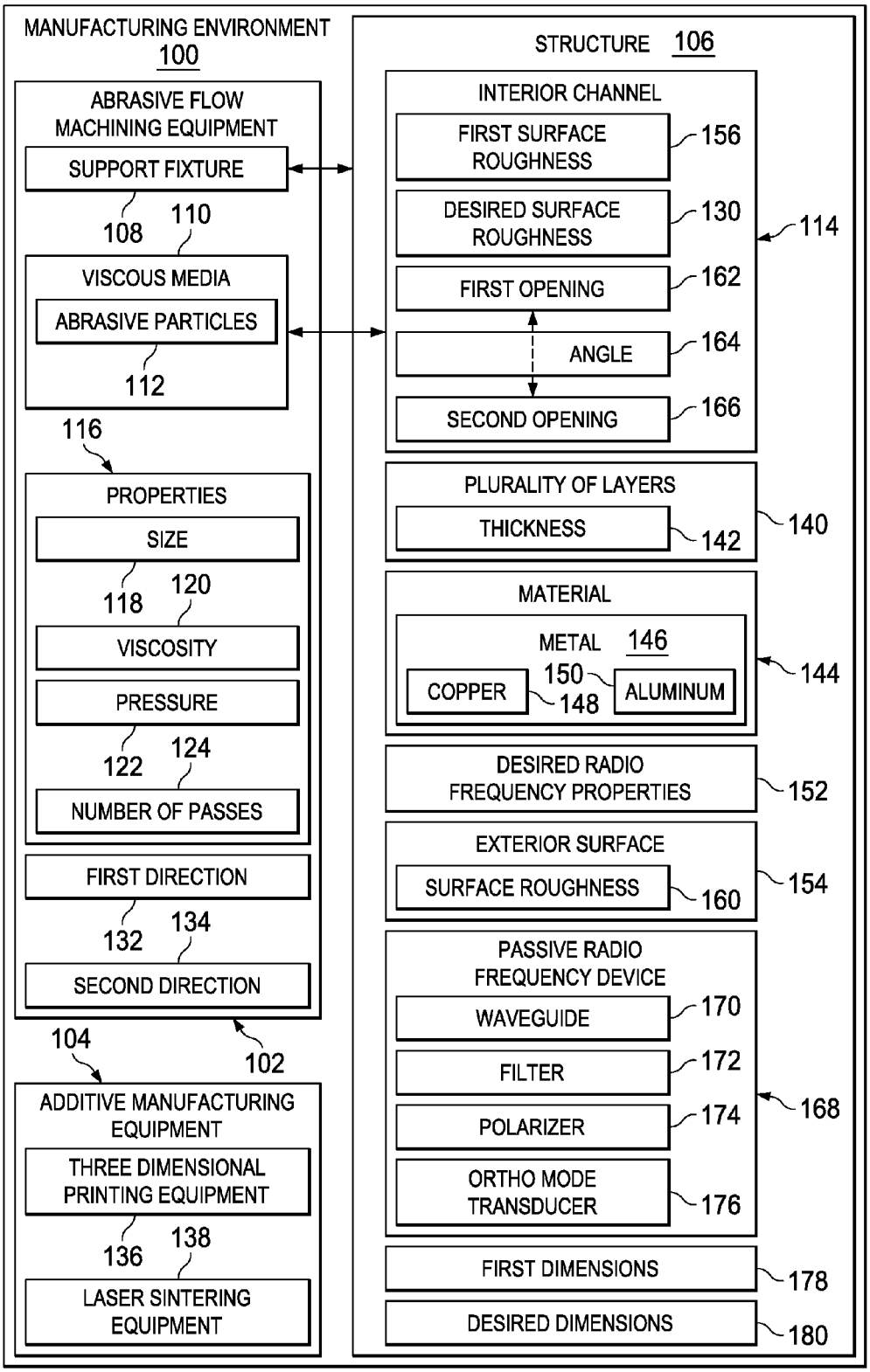
FIG. 1 is an illustration of a manufacturing environment in the form of a block diagram in accordance with an illustrative embodiment.

With reference now to the figures, and in particular, with reference to FIG. 1, an illustration of a manufacturing environment in the form of a block diagram is depicted in accordance with an illustrative embodiment. In this illustrative example, manufacturing environment 100 in FIG. 1 is depicted in block form to illustrate different components for one or more illustrative embodiments. As depicted, manufacturing environment 100 includes abrasive flow machining equipment 102, additive manufacturing equipment 104, and structure 106. As depicted, manufacturing environment 100 may be used to manufacture structure 106.

Abrasive flow machining equipment 102 includes support fixture 108 and viscous media 110 containing abrasive particles 112. Abrasive flow machining equipment 102 may be used to remove material from structure 106. Specifically, abrasive flow machining equipment 102 may remove material from interior channel 114 of structure 106.

Support fixture 108 may hold structure 106 within abrasive flow machining equipment 102 so that viscous media 110 may be sent through interior channel 114. Structure 106 may be held in abrasive flow machining equipment 102 with support fixture 108. Support fixture 108 may be configured to hold structure 106.

Abrasive flow machining equipment 102 has properties 116 which may be selected to provide desired surface roughness 130 in interior channel 114. Properties 116 may include at least one of size 118, viscosity 120, pressure 122, number of passes 124, and any other desirable property of abrasive flow machining equipment 102. Size 118 is the size of abrasive particles 112 within viscous media 110. Viscosity 120 is the viscosity of viscous media 110. Pressure 122 is the amount of pressure used to send viscous media 110 through interior channel 114. Number of passes 124 is the number of times viscous media 110 is sent through interior channel 114. Number of passes 124 may be one or more times. In one illustrative example, viscous media 110 may be sent through interior channel 114 twice. In this illustrative example, viscous media 110 may be sent through interior channel 114 from first direction 132 and then sent through interior channel 114 from second direction 134.

As used herein, the phrase "at least one of," when used with a list of items, means different combinations of one or more of the listed items may be used and only one of each item in the list may be needed. For example, "at least one of item A, item B, or item C" may include, without limitation, item A or item A and item B. This example also may include item A, item B, and item C or item B and item C. The item may be a particular object, thing, or a category. In other words, at least one of means any combination of items and number of items may be used from the list but not all of the items in the list are required.

In some illustrative examples, properties 116 may stay the same throughout processing of structure 106. In some illustrative examples, properties 116 may be changed during processing of structure 106. In one illustrative example, abrasive flow machining equipment 102 may be used with a first size of abrasive particles 112 in size 118. The viscous media 110 may then be changed to have a second size of abrasive particles 112 in size 118.

Additive manufacturing equipment 104 may form structure 106 through additive manufacturing processes. Conventional machining processes may form structures by removing material. Additive manufacturing processes form structures by adding material. Specifically, additive manufacturing processes may form structures by adding consecutive and discrete layers.

Additive manufacturing equipment 104 may take the form of at least one of three dimensional printing equipment 136, laser sintering equipment 138, or any other desirable additive manufacturing equipment.

In one illustrative example, additive manufacturing equipment 104 may form structure 106 by sequentially forming plurality of layers 140 each having thickness 142. Thickness 142 of each of plurality of layers 140 may depend on the resolution of additive manufacturing equipment 104. In other words, thickness 142 may be limited by the capabilities of additive manufacturing equipment 104. For example, thickness 142 may be about 20 micrometers to about 100 micrometers.

Additive manufacturing equipment 104 may form structure 106 from material 144. Material 144 may be metal 146 such as copper 148 or aluminum 150. Accordingly, in some illustrative examples, plurality of layers 140 may comprise a plurality of layers of metal 146. In some illustrative examples, material 144 may comprise at least one of copper 148, a copper alloy, aluminum 150, or an aluminum alloy. Material 144 may be selected to provide desired radio frequency properties 152 for structure 106.

Structure 106 has interior channel 114 and exterior surface 154. As formed, structure 106 has first dimensions 178. In illustrative examples in which structure 106 is formed using additive manufacturing equipment 104, interior channel 114 has first surface roughness 156. First surface roughness 156 may be a result of the resolution of additive manufacturing equipment 104. First surface roughness 156 may be a higher roughness than desired surface roughness 130. First surface roughness 156 may be an undesirable surface roughness for structure 106. An undesirable surface roughness may cause undesirable changes in functionality of structure 106, such as scattering loss. In some illustrative examples, first surface roughness 156 may be about 200 to 400 microinches.

A desired surface roughness may be one such that structure 106 performs at a desired level of functionality. In some illustrative examples, a desired level of performance may be the manner in which waves travel or are processed by structure 106. In one illustrative example, a maximum value for desired surface roughness 130 may be about 63 microinches.

Interior channel 114 has first opening 162 and second opening 166. First opening 162 may be oriented relative to second opening 166 by angle 164. Angle 164 may be between about zero and about 180 degrees. In some illustrative examples, angle 164 may be about zero degrees. In these illustrative examples, structure 106 may be a straight structure. In some illustrative examples, angle 164 may be about ninety degrees.

In the illustrative example, exterior surface 154 has surface roughness 160. Surface roughness 160 may be substantially the same as first surface roughness 156. Surface roughness 160 may be a result of the resolution of additive manufacturing equipment 104.

In some illustrative examples, structure 106 may take the form of passive radio frequency device 168. Passive radio frequency device 168 may be selected from a group of waveguide 170, filter 172, polarizer 174, or ortho mode transducer 176.

After forming structure 106 using additive manufacturing equipment 104, abrasive flow machining equipment 102 may be used to provide desired surface roughness 130 in interior channel 114. Abrasive flow machining equipment 102 may remove material from structure 106 to provide desired surface roughness 130. Removing material from structure 106 may change dimensions of structure 106. Structure 106 may be designed such that structure 106 has desired dimensions 180 after abrasive flow machining equipment 102 provides desired surface roughness 130. First dimensions 178 may be selected based on properties 116 such that structure 106 has desired dimensions 180 after abrasive flow machining equipment 102 is used.

After using abrasive flow machining equipment 102, structure 106 may be joined to other structures. In some illustrative examples, after using abrasive flow machining equipment 102, an antenna may be assembled using structure 106. In one illustrative example, structure 106 may be waveguide 170. In this illustrative example, assembling an antenna may comprise attaching waveguide 170 to a second waveguide having a second interior channel. In this illustrative example, the second interior channel may be oriented at a 90 degree angle to interior channel 114.

Accordingly, using additive manufacturing equipment 104 and abrasive flow machining equipment 102 in combination to form structure 106, structure 106 may have desirable surface roughness 130. Structure 106 may be a metal structure. Specifically, the use of additive manufacturing equipment 104 and abrasive flow machining equipment 102 in combination may form structure 106 having complex internal channel 114 having a maximum for desired surface roughness 130 of 63 microinches.

The illustration of manufacturing environment 100 in FIG. 1 is not meant to imply physical or architectural limitations to the manner in which an illustrative embodiment may be implemented. Other components in addition to or in place of the ones illustrated may be used. Some components may be unnecessary. Also, the blocks are presented to illustrate some functional components. One or more of these blocks may be combined, divided, or combined and divided into different blocks when implemented in an illustrative embodiment.

For example, structure 106 may have more than one angle between first opening 162 and second opening 166. Further, structure 106 could be formed from at least one of titanium, nickel, other metals, or other metal alloys.

As another illustrative example, additive manufacturing equipment 104 may form structure 106 from a material other than material 144. For example, structure 106 may be formed from another material and then electroplated with material 144. In some illustrative examples, after forming structure 106, structure 106 may be electroplated with at least one of copper 148, a copper alloy, aluminum 150, or an aluminum alloy. In one illustrative example, interior channel 114 may be electroplated after abrasive flow machining equipment 102 has been used to provide desired surface roughness 130 in interior channel 114.

As yet another illustrative example, passive radio frequency device 168 may be another device other than waveguide 170, filter 172, polarizer 174, or ortho mode transducer 176. For example, passive radio frequency device 168 may be a waveguide transition, a waveguide splitter, a waveguide combiner, or any other desirable passive radio frequency device.

Figure 2:
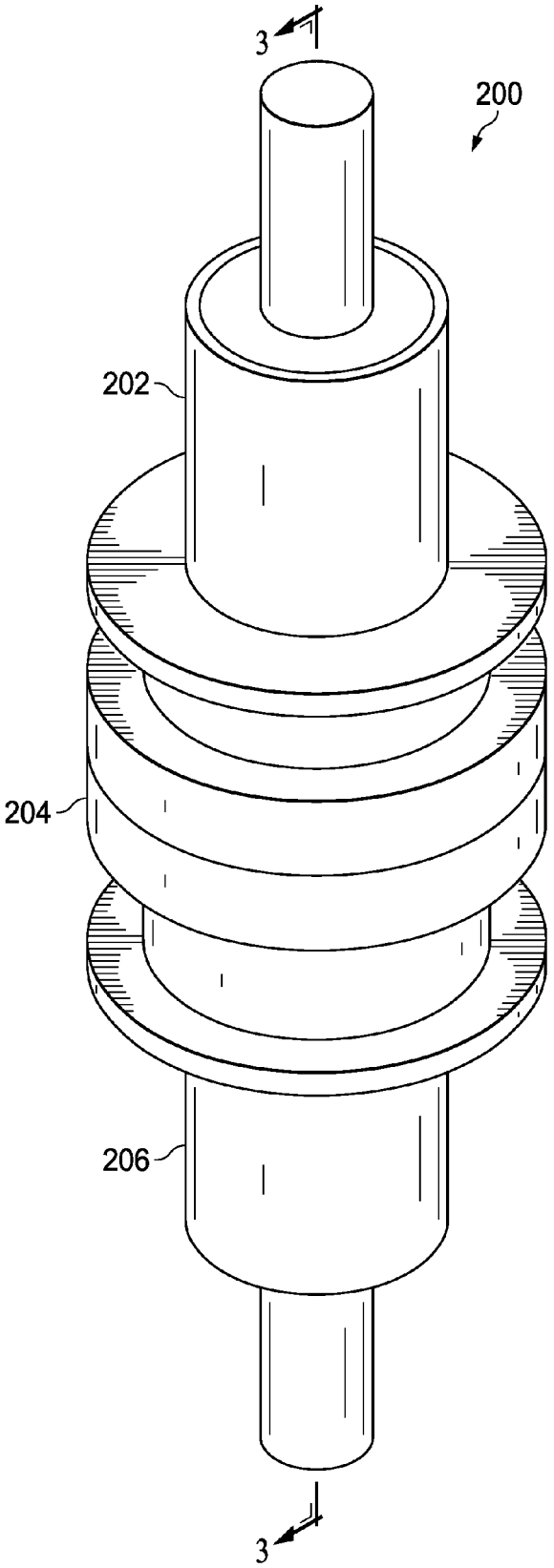
FIG. 2 is an illustration of abrasive flow machining equipment in accordance with an illustrative embodiment.

Turning now to FIG. 2, an illustration of abrasive flow machining equipment is depicted in accordance with an illustrative embodiment. Abrasive flow machining equipment 200 is a physical implementation of abrasive flow machining equipment 102.

In this illustrative example, abrasive flow machining equipment 200 has first piston section 202, support fixture 204, and second piston section 206. Abrasive flow machining equipment 200 may be used to remove material from an interior channel of a structure to produce a desired surface roughness.

The illustration of FIG. 2 is not meant to imply physical or architectural limitations to the manner in which an illustrative embodiment may be implemented. Other components in addition to or in place of the ones illustrated may be used. Some components may be unnecessary.

For example, abrasive flow machining equipment 200 may not comprise first piston section 202 and second piston section 206. In some illustrative examples, abrasive flow machining equipment 200 may comprise one or more alternative pressure supply devices. For example, in one illustrative example, abrasive flow machining equipment 200 may comprise one or more pumps. The one or more pumps may send viscous media 110 through a structure.

Figure 3:
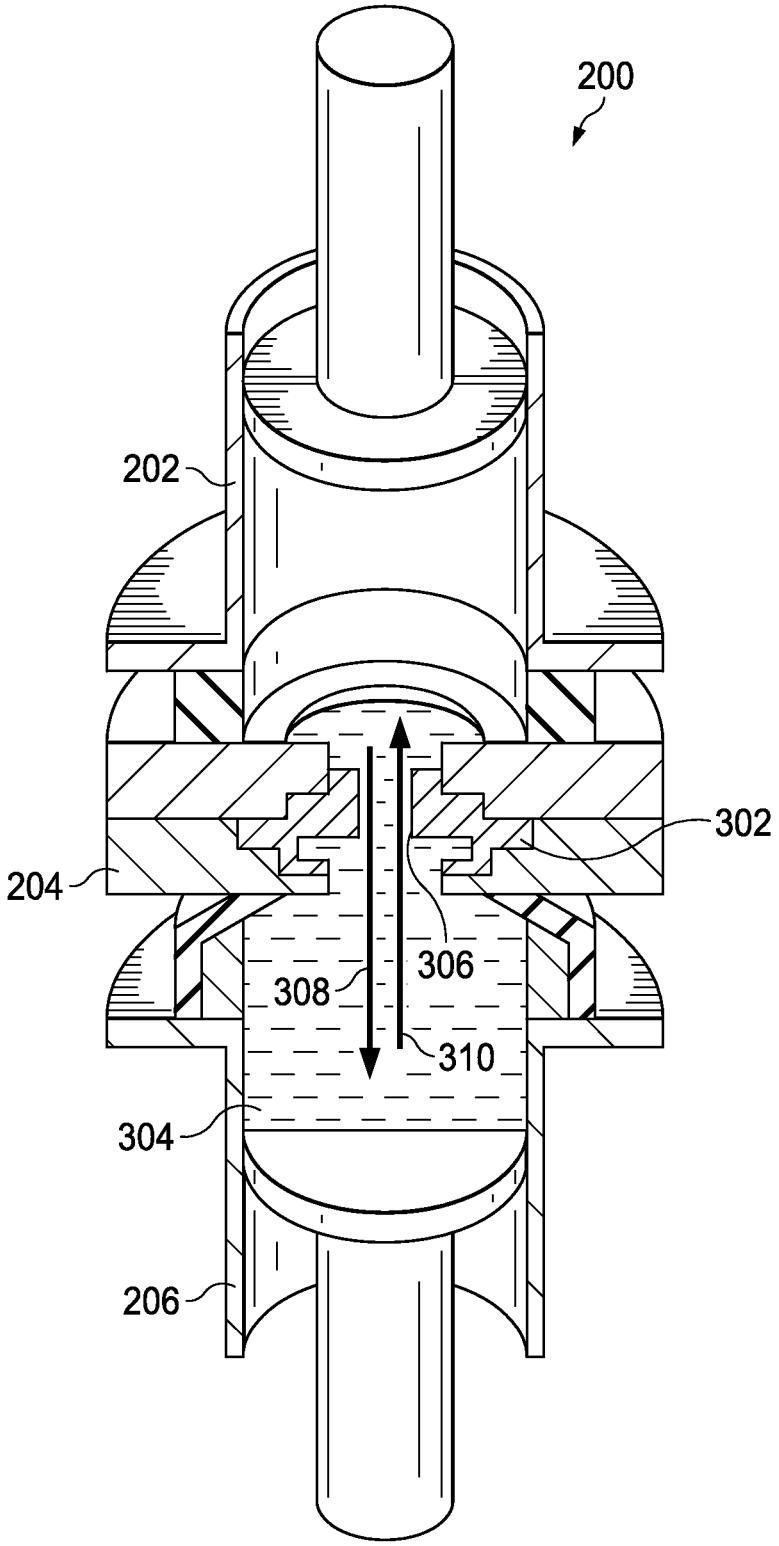
FIG. 3 is an illustration of a cross-section of abrasive flow machining equipment in accordance with an illustrative embodiment.

Turning now to FIG. 3, an illustration of a cross-section of abrasive flow machining equipment is depicted in accordance with an illustrative embodiment. Specifically, FIG. 3 is a view along line 3-3 of FIG. 2. As depicted, abrasive flow machining equipment 200 is a physical implementation of abrasive flow machining equipment 102 from FIG. 1.

In this illustrative example, abrasive flow machining equipment 200 has first piston section 202, support fixture 204, and second piston section 206. Support fixture 204 holds structure 302 within abrasive flow machining equipment 200 so that viscous media 304 may be sent through interior channel 306. Structure 302 may be placed and secured in abrasive flow machining equipment 200 using support fixture 204. Support fixture 204 may be configured to hold structure 302.

First piston section 202 and second piston section 206 may be used to send viscous media 304 through interior channel 306. First piston section 202 may be used to send viscous media 304 through interior channel 306 in first direction 308. As viscous media 304 exits interior channel 306, viscous media 304 may be collected in second piston section 206. Second piston section 206 may be used to send viscous media 304 through interior channel 306 in second direction 310. As viscous media 304 exits interior channel 306, viscous media 304 may be collected in first piston section 202.

The illustration of FIG. 3 is not meant to imply physical or architectural limitations to the manner in which an illustrative embodiment may be implemented. Other components in addition to or in place of the ones illustrated may be used. Some components may be unnecessary.

For example, abrasive flow machining equipment 200 may not comprise first piston section 202 and second piston section 206. In one illustrative example, abrasive flow machining equipment 200 may comprise a pump in place of first piston section 202. In this illustrative example, viscous media 304 may be sent through structure 302 in first direction 308. In some illustrative examples, viscous media 304 may be collected in structure 302 in a collection device. In some illustrative examples, viscous media 304 may flow out of structure 302 without being collected.

In some illustrative examples, viscous media 304 may be changed. For example, viscous media 304 may be sent through structure 302 for a certain time. Abrasive flow machining equipment 200 may be stopped and viscous media 304 may be changed for another viscous media with at least one of a different viscosity, different sized abrasive particles, or a different pressure.

Figure 4:
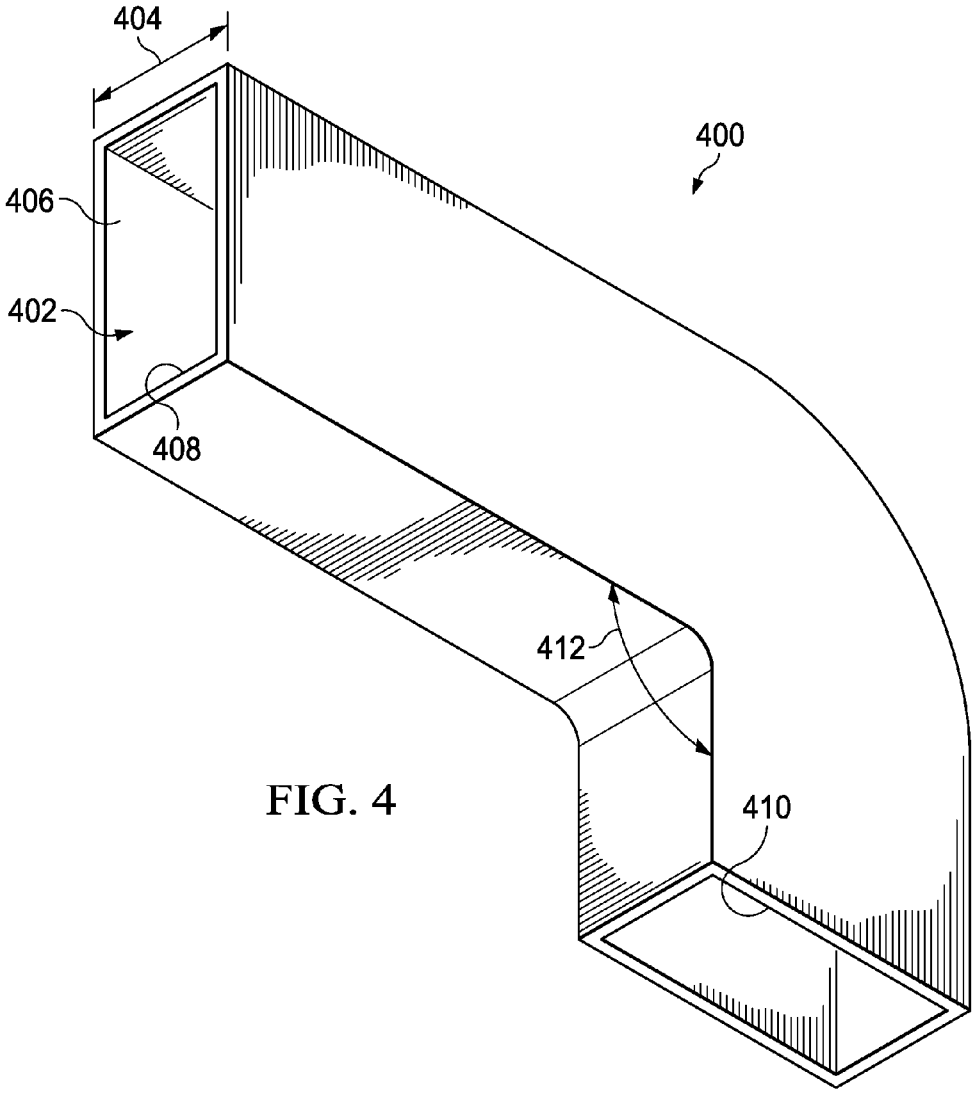
FIG. 4 is an illustration of a waveguide in accordance with an illustrative embodiment.

Turning now to FIG. 4, an illustration of a waveguide is depicted in accordance with an illustrative embodiment. Waveguide 400 may be a physical implementation of waveguide 170 of FIG. 1.

As depicted, waveguide 400 has channel 402. Channel 402 has width 404 and surface 406. Surface 406 has a desired surface roughness. As depicted, channel 402 has first opening 408 and second opening 410. First opening 408 and second opening 410 are oriented at angle 412. As depicted, angle 412 is about a 90 degree angle.

Waveguide 400 is comprised of a plurality of layers of material. In some illustrative examples, the plurality of layers comprise a plurality of layers of metal. Plurality of layers of material may be visible on surface 406. Surface 406 may be substantially free from gouges or scratches.

The illustrations of forming radio frequency hardware in FIGS. 2-4 are not meant to imply limitations to the manner in which other illustrative embodiments may be implemented. For example, waveguide 400 may be formed with an angle other than angle 412.

Also, the different components shown in FIGS. 2-4 may be combined with components in FIG. 1, used with components in FIG. 1, or a combination of the two. Additionally, some of the components in FIGS. 2-4 may be illustrative examples of how components shown in block form in FIG. 1 can be implemented as physical structures.

For example, as discussed above, abrasive flow machining equipment 200 may not comprise first piston section 202 and second piston section 206. Further, in some illustrative examples, abrasive flow machining equipment 200 may comprise using one or more pumps.

Figure 5:
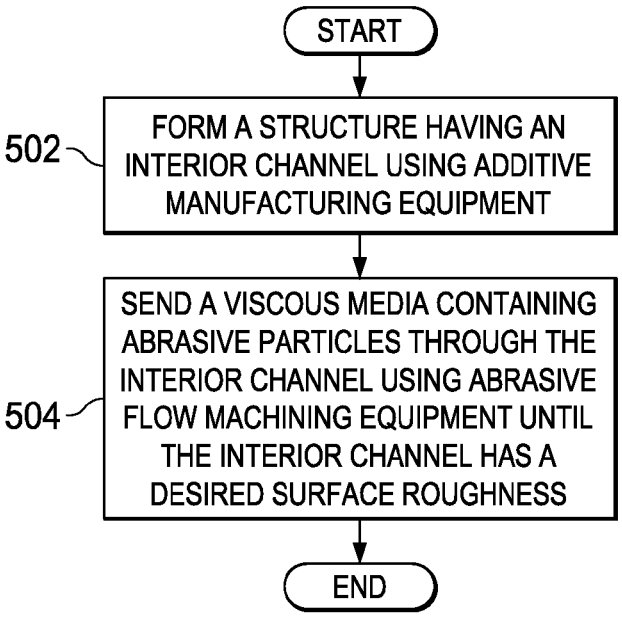
FIG. 5 is an illustration of a flowchart of a process for forming radio frequency hardware in accordance with an illustrative embodiment.

Turning now to FIG. 5, an illustration of a flowchart of a process for forming radio frequency hardware is depicted in accordance with an illustrative embodiment. The process illustrated in FIG. 5 may be implemented in manufacturing environment 100 to form structure 106 having desired surface roughness 130 in FIG. 1. For example, the operations of this process may be implemented in additive manufacturing equipment 104 and abrasive flow machining equipment 102 to form structure 106 from FIG. 1.

The process may begin by forming a structure having an interior channel using additive manufacturing equipment (operation 502). Forming the structure having the interior channel using the additive manufacturing equipment may comprise forming the structure having the interior channel having a surface roughness of approximately 200 to 400 microinches. Operation 502 may be performed by additive manufacturing equipment 104 of FIG. 1. The structure formed using additive manufacturing equipment may be formed by forming plurality of layers 140 having thickness 142. The interior channel of the structure may have first surface roughness 156 after the structure is formed by the additive manufacturing equipment.

The process may then send a viscous media containing abrasive particles through the interior channel using abrasive flow machining equipment until the interior channel has a desired surface roughness (operation 504), with the process terminating thereafter. Abrasive flow machining equipment 102 may send viscous media 110 through interior channel 114 using number of passes 124 in FIG. 1. In some illustrative examples, number of passes 124 may be more than one pass. After using abrasive flow machining equipment 102, interior channel 114 may not have any scratches or gouges. After using abrasive flow machining equipment 102, plurality of layers 140 may be visible in interior channel 114.

Figure 6:
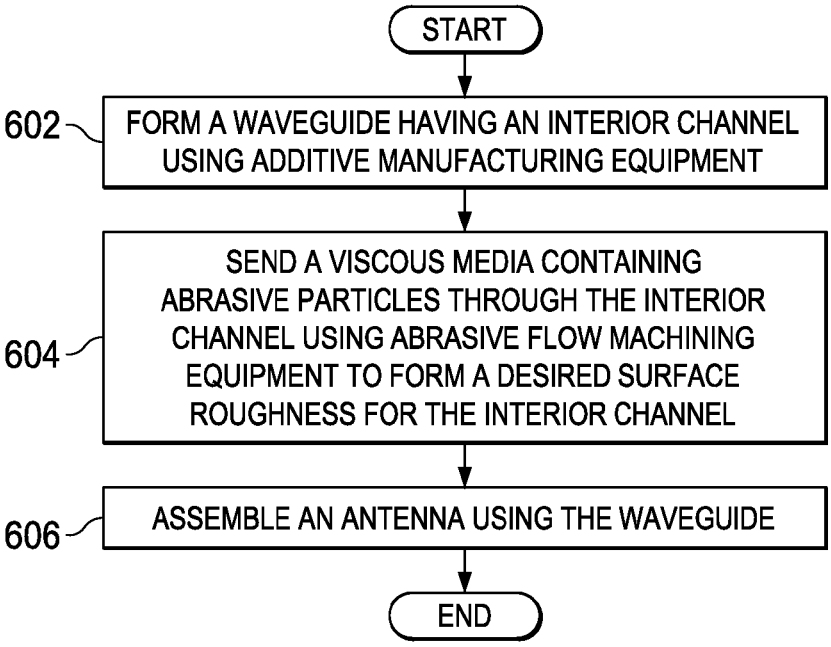
FIG. 6 is an illustration of a flowchart of a process for forming radio frequency hardware in accordance with an illustrative embodiment.

Turning now to FIG. 6, an illustration of a flowchart of a process for forming radio frequency hardware is depicted in accordance with an illustrative embodiment. The process illustrated in FIG. 6 may be implemented in manufacturing environment 100 to form waveguide 170 having desired surface roughness 130 in FIG. 1. For example, the operations of this process may be implemented in additive manufacturing equipment 104 and abrasive flow machining equipment 102 to form waveguide 170.

The process may begin by forming a waveguide having an interior channel using additive manufacturing equipment (operation 602). The process may then send a viscous media containing abrasive particles through the interior channel using abrasive flow machining equipment to form a desired surface roughness for the interior channel (operation 604). Abrasive flow machining equipment 102 has properties 116 which may be selected to provide desired surface roughness 130 in interior channel 114 in FIG. 1. In some illustrative examples, properties 116 may be the same throughout processing. In some illustrative examples, properties 116 may be changed during processing.

Abrasive flow machining equipment 102 may send viscous media 110 through interior channel 114 using number of passes 124 in FIG. 1. In some illustrative examples, number of passes 124 may be more than one pass. After using abrasive flow machining equipment 102, interior channel 114 may not have any scratches or gouges. After using abrasive flow machining equipment 102, plurality of layers 140 may be visible in interior channel 114. The process may then assemble an antenna using the waveguide (operation 606), with the process terminating thereafter. In one illustrative example, assembling the antenna may comprise attaching waveguide 170 of FIG. 1 to a second waveguide having a second interior channel, wherein the second interior channel may be oriented at a 90 degree angle to interior channel 114.

Figure 7:
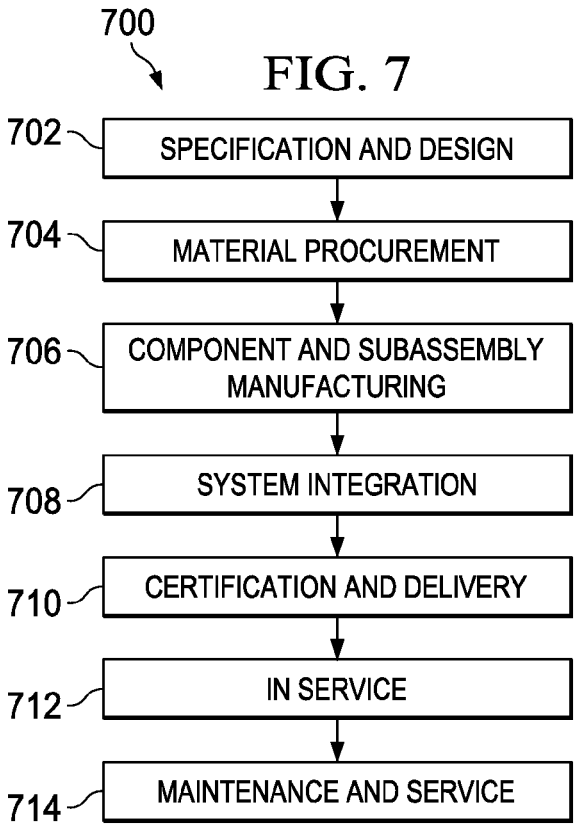
FIG. 7 is an illustration of an aircraft manufacturing and service method in the form of a block diagram in accordance with an illustrative embodiment.
Figure 8:
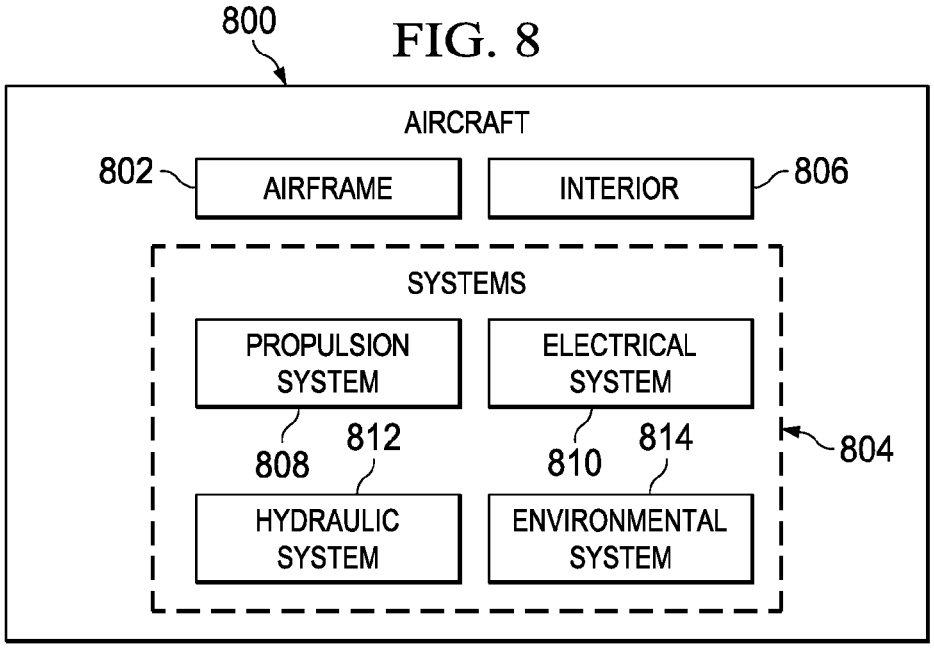
FIG. 8 is an illustration of an aircraft in the form of a block diagram in which an illustrative embodiment may be implemented.

Illustrative embodiments of the disclosure may be described in the context of aircraft manufacturing and service method 700 as shown in FIG. 7 and aircraft 800 as shown in FIG. 8. Turning first to FIG. 7, an illustration of an aircraft manufacturing and service method in the form of a block diagram is depicted in accordance with an illustrative embodiment. During pre-production, aircraft manufacturing and service method 700 may include specification and design 702 of aircraft 800 in FIG. 8 and material procurement 704.

During production, component and subassembly manufacturing 706 and system integration 708 of aircraft 800 in FIG. 8 takes place. Thereafter, aircraft 800 in FIG. 8 may go through certification and delivery 710 in order to be placed in service 712. While in service 712 by a customer, aircraft 800 in FIG. 8 is scheduled for routine maintenance and service 714, which may include modification, reconfiguration, refurbishment, and other maintenance or service.

Each of the processes of aircraft manufacturing and service method 700 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of vendors, subcontractors, and suppliers; and an operator may be an airline, a leasing company, a military entity, a service organization, and so on.

With reference now to FIG. 8, an illustration of an aircraft in the form of a block diagram is depicted in which an illustrative embodiment may be implemented. In this example, aircraft 800 is produced by aircraft manufacturing and service method 700 in FIG. 7 and may include airframe 802 with plurality of systems 804 and interior 806. Examples of systems 804 include one or more of propulsion system 808, electrical system 810, hydraulic system 812, and environmental system 814. Passive radio frequency device 168 of FIG. 1 may be implemented in portions of aircraft 800. In some illustrative examples, passive radio frequency device 168 may be used for communications or radar purposes. In some illustrative examples, passive radio frequency device 168 may be attached to airframe 802. Any number of other systems may be included. Although an aerospace example is shown, different illustrative embodiments may be applied to other industries, such as the automotive industry.

Apparatuses and methods embodied herein may be employed during at least one of the stages of aircraft manufacturing and service method 700 in FIG. 7. One or more illustrative embodiments may be used during component and subassembly manufacturing 706. For example, structure 106 in FIG. 1 may be used during component and subassembly manufacturing 706. Structure 106 may be coupled to other portions of an aircraft during system integration 708. Further, structure 106 may also be used to perform replacements during maintenance and service 714.

Structure 106 may be part of or coupled to airframe 802 of aircraft 800. For example, structure 106 may take the form of passive radio frequency device 168 coupled to airframe 802 of aircraft 800. In some illustrative examples, structure 106 may form part of electrical system 810. In some illustrative examples, structure 106 may be electrically coupled to electrical system 810. may be inspected during scheduled maintenance for aircraft 800.

By using additive manufacturing and abrasive flow machining in combination to form a structure, the structure may have desirable surface roughness. This structure may be a metal structure. Specifically, the use of additive manufacturing and abrasive flow machining in combination may form structures having complex internal channels having a maximum desired surface roughness of 63 microinches.

By using additive manufacturing equipment 104 and abrasive flow machining equipment 102, passive radio frequency device 168 may be manufactured to have desired surface roughness 130 in interior channel 114. By using additive manufacturing equipment 104 and abrasive flow machining equipment 102, passive radio frequency device 168 may be manufactured using fewer resources than conventional methods such as investment casting, electroforming, brazing, or drawing of metal tubes. For example, using additive manufacturing equipment 104 and abrasive flow machining equipment 102, passive radio frequency device 168 may be manufactured in less time. Additionally, using additive manufacturing equipment 104 and abrasive flow machining equipment 102, passive radio frequency device 168 may be manufactured with less material waste.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A method of manufacturing a part comprising:

sintering additive layers to form a structure having complex channels, wherein the complex channels comprise multiple perpendicular angles;

holding the structure in an abrasive flow machining workpiece, wherein the structure has the same shape as the abrasive flow machining workpiece; and sending a viscous media containing abrasive particles through the complex channels using the abrasive flow machining workpiece to form a desired surface roughness for the complex channels.

2. The method of claim 1, wherein holding the structure in the abrasive flow machining workpiece comprises holding the structure with a support fixture.

3. The method of claim 1, wherein sending the viscous media containing the abrasive particles through the complex channels causes the structure to have desired dimensions.

4. The method of claim 1, wherein a maximum value for the desired surface roughness is approximately 63 microinches.

5. The method of claim 1, wherein sintering the additive layers to form the structure having complex channels results in the complex channels having a surface roughness of approximately 200 to 400 microinches.

6. The method of claim 1, wherein the structure is a passive radio frequency device.

7. The method of claim 1, wherein the structure is selected from a group of a waveguide, a filter, a polarizer, and an ortho mode transducer.

8. The method of claim 1, wherein the additive layers comprise at least one of aluminum, aluminum alloy, copper, or copper alloy.

9. A method comprising:

sintering additive layers to form a waveguide having complex channels, wherein the complex channels comprise multiple perpendicular angles;

holding the waveguide in an abrasive flow machining workpiece, wherein the waveguide has the same shape as the abrasive flow machining workpiece;

sending a viscous media containing abrasive particles through the complex channels using the abrasive flow machining workpiece to form a desired surface roughness for the complex channels; and assembling an antenna using the waveguide.

10. The method of claim 9, wherein the additive layers comprise at least one of aluminum, aluminum alloy, copper, or copper alloy.

11. The method of claim 9, wherein the waveguide is a first waveguide, the complex channels are first complex channels, and assembling the antenna further comprises attaching the first waveguide to a second waveguide having second complex channels, wherein the second complex channels are oriented at a 90 degree angle to the first complex channels.

12. The method of claim 1, further comprising:

electroplating the complex channels.

13. The method of claim 6, wherein the passive radio frequency device is selected from a group of a waveguide transition, a waveguide splitter, and a waveguide combiner.

* * * * *